United States Patent [19]

Aboelfotoh

[11] 4,053,804

[45] Oct. 11, 1977

[54] DIELECTRIC FOR GAS DISCHARGE PANEL

[75] Inventor: M. Osama Aboelfotoh, Poughkeepsie, N.Y.

[73] Assignee: International Business Machines Corporation, Armonk, N.Y.

[21] Appl. No.: 636,180

[22] Filed: Nov. 28, 1975

[51] Int. Cl.[2] ..... H01J 17/04

[52] U.S. Cl. ..... 313/218; 313/220; 313/221; 315/169 TV

[58] Field of Search ..... 313/201, 218, 220, 221; 315/169 TV

[56] References Cited

U.S. PATENT DOCUMENTS

| | | | |
|---|---|---|---|
| 3,836,393 | 9/1974 | Ernsthausen et al. | 117/217 |
| 3,846,670 | 11/1974 | Schaufele | 315/169 TV |
| 3,863,089 | 1/1975 | Ernsthausen et al. | 313/201 |

*Primary Examiner*—Rudolph V. Rolinec
*Assistant Examiner*—Vincent J. Sunderdick
*Attorney, Agent, or Firm*—Joseph J. Connerton

[57] ABSTRACT

A high resolution gaseous discharge display and/or memory device comprises a panel array of bistable charge storage areas designated gaseous discharge cells or sites, each cell having an associated pair of coordinate orthogonal conductors defining the cell walls which, when appropriately energized, produce a confined gaseous discharge in the selected sites. The conductors are insulated from direct contact with the gas by a dielectric insulator, the dielectric insulator being composed of a layer of refractory material having high secondary emission characteristics such as magnesium oxide doped with gold to prevent degradation of the dielectric layer during operation, to increase the memory margin and extend the life of the gaseous discharge panel, and to control the secondary emission characteristics and provide stable operating voltages for the panel.

13 Claims, 2 Drawing Figures

DIELECTRIC FOR GAS DISCHARGE PANEL

CROSS REFERENCE TO RELATED APPLICATIONS

U.S. Application Ser. No. 405,205 filed by Peter H. Haberland et al, Oct. 10, 1973, now U.S. Pat. No. 3,837,724.

U.S. Application Ser. No. 372,384 for "Improved Method and Apparatus for a Gas Display Panel" filed by Tony N. Criscimagna et al, June 21, 1973.

BACKGROUND OF THE INVENTION

Plasma or gaseous discharge display and/or storage apparatus have certain desirable characteristics such as small size, a thin flat display package, relatively low power requirements and inherent memory capability which render them particularly suitable for display apparatus. One example of such known gaseous discharge devices is disclosed in U.S. Pat. No. 3,559,190, "Gaseous Display and Memory Apparatus", patented Jan. 26, 1971 by Donald L. Bitzer et al. and assigned to the University of Illinois. Such panels, designated a.c. gas panels, may include an inner glass layer of physically isolated cells or comprise an open panel configuration of electrically insulated but not physically isolated gas cells. In the open panel configuration which represents the preferred embodiment of the instant invention, a pair of glass plates having dielectrically coated conductor arrays formed thereon are sealed with the conductors in substantially orthogonal relationship. When appropriate drive signals are applied to selected pairs or groups of conductors, the signals are capacitively coupled to the gas through the dielectric. When these signals exceed the breakdown voltage of the gas, the gas discharges in the selected area, and the resulting charge particles, ions and electrons, are attracted to the wall having a potential opposite the polarity of the particle. This wall charge opposes the drive signal which produce and maintain the discharge, rapidly extinguishing the discharge and assisting the breakdown in the next alternation. Each discharge produces light emission from the selected cell or cells, and by operating at a relatively high frequency in the order of 30–40 kilocycles, a flicker-free display is provided. After initial breakdown, the wall charge condition is maintained in selected cells by application of a lower potential designated the sustain signal which, combined with the wall charge, causes the selected cells to be reingnited and extinguished continuously at the applied frequency to maintain a continuous display.

The capacitance of the dielectric layer is determined by the thickness of the layer, the dielectric constant of the material and the geometry of the drive conductors. The dielectric material must be an insulator having sufficient dielectric strength to withstand the voltage produced by the wall charge and the externally applied potential. The dielectric should be a relatively good emitter of secondary electrons to assist in maintaining the discharge, be transparent or translucent on the display side to transmit the light generated by the discharge for display purposes, and be susceptible to fabrication without reacting with the conductor metallurgy. Finally, the coefficient of expansion of the dielectric should be compatible with that of the glass substrate on which the dielectric layer is formed.

One material possessing the above characteristics with respect to a soda-lime-silica substrate is lead-borosilicate solder glass, a glass containing in excess of 75 percent lead oxide. In an embodiment constructed in accordance with the teaching of the present invention, a dielectric comprising a layer of lead-borosilicate glass was employed as the insulator. However, chemical and physical reaction on the surface of the dielectric glass under discharge conditions produced degradation or decomposition of the lead oxide on the dielectric surface, thereby producing variations in the electrical characteristics of the gaseous display panel on a cell-by-cell basis. This degradation, resulting primarily from ion bombardment of the dielectric surface, caused the electrical parameters of the individual cells in the gaseous discharge device to vary as a function of the cell history such that over a period of time, the required firing voltage for individual cells fell outside the normal operating range, and the firing voltage varied on a cell-by-cell basis.

In order to avoid degradation of the dielectric surface resulting from ion bombardment in a gaseous discharge device, a refractory material having a high binding energy is utilized to protect the dielectric surface. A refractory material is one which resists ordinary treatment, is difficult to reduce and has a high binding energy such that its constituents remain constant even after prolonged use. It is also known in the art that the breakdown voltage in a gaseous discharge device may be lowered by utilizing a material having a high coefficient of secondary emission characteristics such as magnesium oxide. However, magnesium oxide reacts with the dielectric glass during fabrication and has a tendency to crack or craze during the fabrication process. In addition, the secondary emission characteristic of magnesium oxide may be too high for certain applications.

With respect to gas panel fabrication and test, the conventional process requires a significant burn-in time in the general order of 16 hours as the final step. When alternate line testing was employed in a panel having a magnesium oxide dielectric surface, a lowering of the memory margin, the difference between the maximum and minimum sustain voltage, was noted in the tested lines as compared to the non-tested lines. This phenomenon, known as alternate line aging, reduced the memory margin of the tested cells below acceptable limits resulting in rejection of a substantial number of panels.

SUMMARY OF THE INVENTION

In accordance with the instant invention, a layer or coating of magnesium oxide, a refractory material characterized by a high coefficient of secondary emission, is doped with gold and applied over the entire surface of the dielectric layer. By utilizing a layer of refractory material having high secondary emission characteristics, the secondary electron emission characteristics dominate the electric operating conditions in the gas panel, resulting, as more fully described hereinafter, in gaseous discharge operation with lower operating voltages. However, the secondary emission characteristics may be controlled or tuned by the amount of gold utilized, which may range between 5% and 20% by volume. In a preferred embodiment of the instant invention, a thin layer of magnesium oxide and gold having thermal expansion characteristics compatible with that of the lead-borosilicate dielectric, is employed. The refractory characteristic of the magnesium oxide and gold coating is highly resistant to chemical and physical reaction from the discharge process, thus maintaining the electrical parameters of the gas panel substantially constant with time and thereby extending the useful life of the gas panel. The memory margin of the cells is increased by increasing the maximum sustain voltage while maintaining the minimum sustain voltage essentially constant. the alternate line aging problem is virtually eliminated, while the burn-in time of the panel is significantly reduced from a period of hours to a period of minutes. In lieu of a separate layer or overcoat of gold doped magnesium oxide over the dielectric, a thicker layer of gold doped magnesium oxide may be used as the dielectric.

Accordingly, a primary object of the present invention is to provide an improved gaseous discharge display panel.

Another object of the present invention is to provide an improved gaseous discharge display panel utilizing a surface of gold doped magnesium oxide having a high secondary emission characteristic adjacent to and in continuous contact with the gas to improve the memory margin of the device.

Still another object of the present invention is to provide an improved gaseous discharge display panel having an inner surface of gold doped magnesium oxide in contact with the gas to prevent degradation of the dielectric material, to extend panel life and to stabilize the operating potentials required for gas panel operation.

Another object of the instant invention is to provide an improved gas panel assembly adapted to eliminate the alternate line aging problem and to substantially reduce the test time of the assembly.

The foregoing and other objects, features and advantages of the present invention will be apparent from the following description of a preferred embodiment of the invention as illustrated in the accompanying drawings.

DESCRIPTION OF A PREFERRED EMBODIMENT

Figure 1:
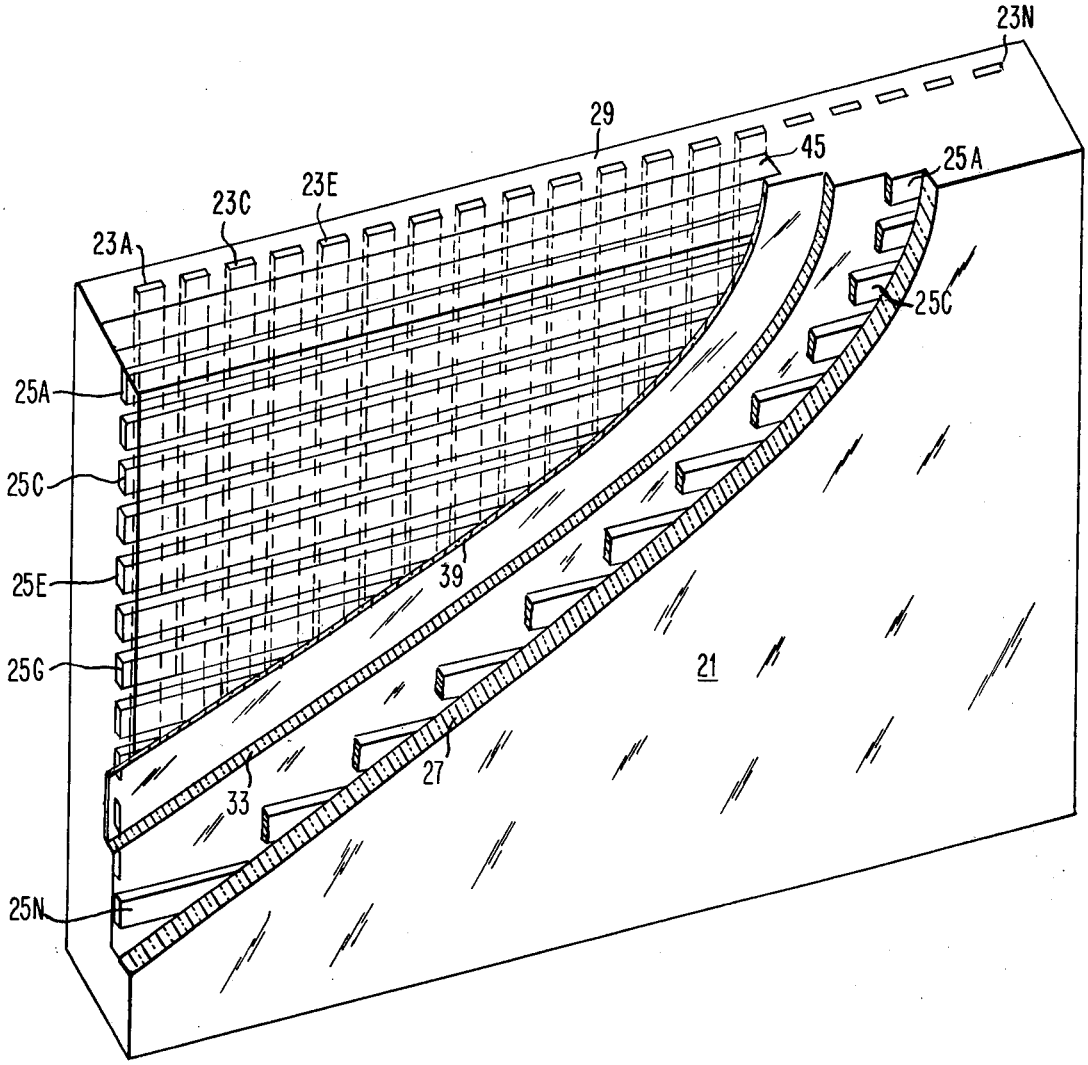
FIG. 1 is an isometric view of a gaseous discharge panel broken away to illustrate details of the present invention.

Referring now to the drawings and more particularly to FIG. 1 thereof, there is illustrated a gas panel 21 comprising a plurality of individual gas cells or sites defined by the intersection of vertical drive lines 23A–23N and horizontal drive lines 25A–25N. The structure of the preferred embodiment as shown in the drawings is enlarged, although not to scale, for purposes of illustration; however, the physical and electrical parameters of the invention defined in the instant application are fully described in detail hereinafter. While only the viewing portion of the display panel is illustrated in the interest of clarity, it will be appreciated that in practice the drive conductors extend beyond the viewing area for interconnection to the driving signal source.

The gas panel 21 includes an illuminable gas such as a mixture of neon and argon within a sealed structure, the vertical and horizontal conductor arrays being formed on associate glass plates and disposed in orthogonal relationship on opposite sides of the structure. Gas cells within the panel are selectively ionized during a write operation by applying to the associated conductors coincident potentials having a magnitude sufficient when algebraically added to exceed the breakdown voltage $V_B$. In the preferred embodiment, the control potentials for write, read and erase operations are rectangular a.c. signals of the type described in aforenoted copending application Ser. No. 372,384. Typical operating potentials for a gaseous discharge panel with nominal deviations using a neon-argon gas mixture are 150 volts for write, 93 to 99 volts for sustain $V_S$ maximum, depending on the percentage of gold and 82 volts for sustain minimum voltage $V_S$ minimum. For 20% gold, $V_S$ maximum is 99 volts, while for ;b 5% gold, $V_S$ maximum is 91 volts. Once the wall charge has been established, the gas cells are maintained in the discharge state by a lower amplitude periodic sustain signals. Any of the the selected cells may be extinguished, termed an erase operation, by reducing the potential difference across the cell and neutralizing the wall charges so that the sustain signal is not adequate to maintain the discharge. By selective write operations, information may be generated and displayed as a sequence of lighted cells or sites in the form of alphanumeric or graphic data, and such information may be regenerated as long as desired by the sustain operation.

Since the dielectric interfaces directly with the gas, it may be considered a gas panel envelope comprising relatively thin or fragile sheets of dielectric material such that a pair of glass substrates 27, 29, front and rear, is employed as supporting members on opposite sides of the panel. The only requirement for such support members is that they be non-conductive and good insulators, and substantially transparent for display purposes. One-quarter inch thick commercial grade soda-lime-silica glass is utilized in the preferred embodiment.

Figure 2:
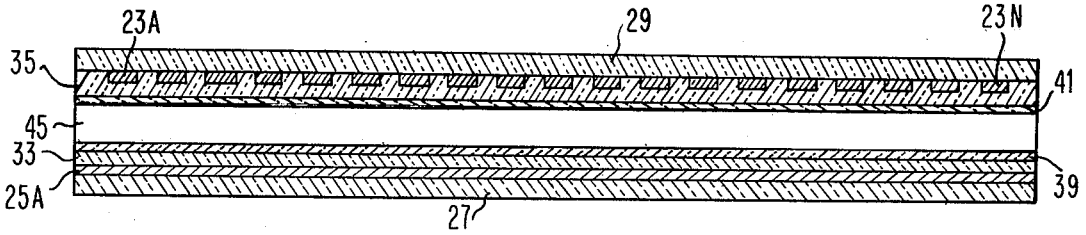
FIG. 2 is a top view of the gaseous discharge panel illustrated in FIG. 1.

Shown also in cutaway is conductor array 25 which is interposed between the glass substrate 27 and associated dielectric member 33. The corresponding configuration for conductor array 23 is illustrated in FIG. 2. Conductor arrays 23, 25 may be formed on substrates 27, 29 by a number of well known processes such as photoetching, vacuum deposition, stencil screening, etc. Transparent, semi-transparent or opaque conductive material such as tin oxide, gold, aluminum or copper can be used to form the conductor arrays, or alternatively the conductor arrays 23, 25 may be wires or filaments of copper, gold, silver or aluminum or any other conductive metal or material. However, formed in situ conductor arrays are preferred, since they may be more easily and more uniformly deposited on and adhere to the substrates 27, 29. In a preferred embodiment constructed in accordance with the instant invention, opaque chrome-copper-chrome conductors are utilized, the copper layer serving as the conductor, the lower layer of chrome providing adhesion to the associated substrate, while the upper layer of chrome protects the copper conductor from attack by the lead-borosilicate insulator during fabrication.

Dielectric layers 33, 35, layer 33 of which is broken away in FIG. 1, are formed in situ in the preferred embodiment directly over conductor arrays 23, 25 of an inorganic material having an expansion coefficient closely related to that of the substrate members. One preferred dielectric material, as previously indicated, is lead-borosilicate solder glass, a material containing a high percentage of lead oxide. To fabricate the dielectric area, lead-borosilicate glass frit is sprayed over the conductor array and the substrate placed in an oven where the glass frit is reflowed and monitored to ensure appropriate thickness. Alternatively, the dielectric layer could be formed by electron beam evaporation, chemical vapor deposition or other suitable means. The requirements for the dielectric layer have been specified, but additionally the surface of the dielectric layers should be electrically homogeneous on a microscopic scale, i.e., should be preferably free from cracks, bubbles, crystals, dirt, surface films or any impurity or imperfection.

Finally, as heretofore described, the problem of degradation occurring on the dielectric surface during operation of the panel resulting from ion bambardment produced variation of the electrical characteristics of individual cells and significantly reduced panel life. The solution utilized in the preferred embodiment was the deposition of a homogeneous layer of a magnesium oxide having a high secondary emission characteristic doped with gold between the dielectric surface and the gas. Such a mixture may comprise between 5% and 20% gold depending on the desired memory margin and the layer in the preferred embodiment is 2000 A or 0.2 microns thick. Irrespective of the amount of gold, the minimum sustain voltage $V_S$ min. is approximately constant. However, the maximum sustain voltage $V_S$ max. increase with the percentage of gold. In a preferred embodiment constructed in accordance with the teaching of the instant invention, the minimum sustain voltage was 81 volts; the maximum sustain voltage for 5% gold was 91V–93V, while for 20% gold the maximum sustain voltage was 99 volts. Thus a higher memory margin from 18 to 10 volts is provided by the 20% gold composition than by the 5% gold composition. In the above described preferred embodiment, the constituent magnesium oxide and gold were co-evaporated to provide better control of the materials, but a single material having the above prescribed composition of MgO and gold could be evaporated or otherwise applied. An alternative method would be evaporate 1500 angstroms of magnesium oxide followed by a 500 angstrom evaporation of gold and MgO. Since the gold is a chemically inert material, it does not react with the dielectric, and is further refractory in that it does not dissociate under ion bombardment. Another embodiment of the invention utilized a combination of 80% magnesium oxide and 20% gold in a thickness of 10,000 A or 1 micron as the dielectric. Using this arrangement, only a single evaporation is required since the dielectric forming step is eliminated. However, this increases the cost of the material by a factor of five, although the cost of gold utilized in the preferred embodiment is relatively insignificant on a per panel basis.

With respect to material having high secondary electron emission efficiency, the dominant secondary electron production mechanism is defined as emission from the confining boundaries of the gas, which in the instant invention are the dielectric electrode surfaces. The breakdown voltage in a gaseous discharge display panel is determined by the electron amplification of the gas described by a coefficient $\alpha$ and the production of secondary electrons in the volume of the gas and on the confining surfaces or cell walls. For a specified gas mixture, pressure and electrode spacing, $\alpha$ is a monotonically increasing function of the voltage in the ordinary range of panel operation. The secondary electron emission is characterized by a coefficient $\gamma$, which may be a function of the surface material and mode of preparation. Voltage breakdown occurs when the following approximate-relationship is satisfied:

$$\gamma e^{\alpha d} \approx 1$$

where $d$ is the spacing between electrodes. Consideration of the above equation shows that an increase in $\gamma$ will result in a lower value of $\alpha$ at breakdown, and hence a lower breakdown or panel operating voltage $V_B$. $V_S$max. is a function of $\gamma$ while $V_S$min. is primarily determined by wall charge. Thus the use of gold doped magnesium oxide increases $V_S$ max., while $V_S$ min. remains essentially constant to provide increased memory margin.

Referring now to FIG. 2, a top view is employed to clarify certain details of the instant invention, particularly since only a portion of the panel as shown in cutaway in FIG. 1. Two rigid support members or substrates 27 and 29 comprise the exterior member of the display panel, and in a preferred embodiment comprise ¼ inch commercial grade sode-lime-silica glass. Formed on the inner walls of the substrate members 27 and 29 are the horizontal and vertical conductor arrays 25, 23, respectively. The conductor sizes and spacing are obviously enlarged in the interest of clarity.

In typical gas panel configurations, the center-to-center conductor spacing in the respective arrays is between 14 and 60 mils using 3–6 mil wide conductors which may be typically 2.5 microns in thickness. Formed directly over the conductor arrays 25, 23 are the dielectric layers 33 and 35 which, as previously described, may comprise a solder glass such as lead-borosilicate glass containing a high percentage of lead oxide. The dielectric members being of nonconductive glass function as insulators and capacitors for their associated conductor arrays. Lead-borosilicate glass dielectric is preferred since it adheres well to other glasses, has a lower reflow temperature than the soda-lime-silicate glass substrates on which it is laid, and has a relatively high viscosity with a minimum of interaction with the metallurgy of the conductor arrays on which it is deposited. The expansion characterisitcs of the dielectric must be tailored to that of the associated substrate members 27 and 29 to prevent bowing, cracking or distortion of the substrate. As an overlay or a homogenous film, the dielectric layers 33 and 35 are more readily formed over the entire surface of the gaseous discharge device rather than cell-by-cell definition.

The gold doped MgO overcoating over the associated dielectric layer is shown in FIG. 2 as layers 39, 41 which, as previously noted, combine a high secondary electron emission efficiency with a resistance to interaction with the discharge. As in the dielectric layer with respect to the substrate, the overcoating layers 39 and 41 are required to adhere to the surface of the dielectric layers and remain stable under panel fabrication including the high temperature baking and evacuation processes. A 2000 Angstrom thick coating is used in the preferred embodiment. Also as previously described, a single layer of gold magnesium oxide may be substituted for the combined dielectric and overcoating layers 33, 39 and 35, 41 respectively. While the gold doped magnesium oxide coating in the above described embodiment of the instant invention was applied over the entire surface, it will be appreciated that it could be also formed on a site-by-site definition.

The final parameter in the instant invention relates to the gas space or gap 45 between the opposing magnesium oxide surfaces in which the gas is contained. This is a relatively critical parameter in the gas panel, since the intensity of the discharge and the interactions between discharges on adjacent discharge sites are functions of the spacing. While the size of the gap is not shown to scale in the drawings, a spacing of approximately 5 mils is utilized between cell walls in the preferred embodiment. Since a uniform spacing distance must be maintained across the entire panel, suitable spacer means, if needed, could be utilized to maintain this uniform spacing. While the gas is encapsulated in the envelope, additional details regarding sealing of the panel or fabrication details such as the high temperature bakeout, evacuation and backfill steps have been omitted as beyond the scope of the instant invention.

With respect to the reduction in burn-in time of a panel using a gold doped magnsium oxide surface as contrasted to a magnesium oxide surface, a reduction of time from 16 hours at 135 volts was reduced to 10–20 minutes at the same voltage, a most significant reduction. Additionally, there was no significant change in the alternate lines tested as compared to the non-tested lines.

While the invention has been described in terms of a preferred embodiment of gold doped magnesium oxide, it may also be implemented in other Group II A alkaline earth oxides doped with gold, the differences being ones of degrees of secondary emission capability, fabrication complexity, etc. For example, a gas panel having a layer of gold doped barium oxide on the gas interfacing surface has been built and successfully tested. In addition, other oxides such as aluminum oxide $AL_2O_3$, silicon dioxide $SiO_2$ doped with gold have been built and successfully tested, the essential difference being that higher operating voltages may be required due to the lower secondary emission coefficients of these materials relative to magnesium oxide.

While the invention has been particularly shown and described with reference to preferred embodiments thereof, it will be understood by those skilled in the art that other changes in form and details may be made therein without departing from the spirit and scope of the invention.

What is claimed is:

1. In a gaseous discharge display device, the combination comprising an ionizable gaseous medium, a pair of nonconductive support members, conductor arrays formed on each of said support members, and a dielectric medium insulating at least one of said conductor arrays from contact with said gaseous medium, said ionizable gaseous medium contacting surface of said dielectric medium comprising a gold doped oxide in an amount sufficient to increase the memory margin of the panel while affording relatively stable operating voltages.

2. Apparatus of the type claimed in claim 1 wherein said dielectric medium consists of a gold doped alkaline earth oxide.

3. Apparatus of the type claimed in claim 2 wherein said alkaline earth oxide comprises magnesium oxide.

4. Apparatus of the type claimed in claim 2 wherein said dielectric medium is composed of the same material as said gaseous medium contacting surface of said dielectric.

5. Apparatus of the type claimed in claim 3 wherein said gold doped magnesium oxide is in the form of a continuous layer.

6. Apparatus of the type claimed in claim 3 wherein said gold doped magnesium oxide is in the form of a discontinuous layer.

7. In a gaseous discharge device, the combination comprising a pair of nonconductive support members, conductor arrays formed on each of said support members, each of said conductor arrays comprising a plurality of substantially parallel conductors, means for sealing said support memberrs to form a gaseous envelope having an ionizable gaseous medium, the conductors in said arrays being substantially orthogonal, and a dielectric medium formed over at least one of said conductor arrays, whereby the surface of said dielectric medium is in contact with said ionizable gas, said gas contacting surface of said dielectric medium comprising a gold doped oxide to enhance the memory margin of said discharge device.

8. A device of the type claimed in claim 7 wherein said oxide comprises an alkali earth oxide.

9. A device of the type claimed in claim 8 wherein said alkali earth oxide comprises magnsium oxide.

10. A device of the type claimed in claim 8 wherein said alkali earth oxide comprises barium oxide.

11. A device of the type claimed in claim 7 wherein said oxide comprises silicon dioxide.

12. The invention defined in claim 7 wherein each of said conductor arrays has a dielectric medium insulating the conductors from direct contact with the gas.

13. A device of the type claimed in claim 12 wherein said dielectric medium is in the form of a continuous layer over the entire surface of said gaseous medium.

* * * * *